US005316837A

United States Patent [19]

Cohen

[11] Patent Number: 5,316,837

[45] Date of Patent: May 31, 1994

[54] STRETCHABLE METALLIZED NONWOVEN WEB OF NON-ELASTOMERIC THERMOPLASTIC POLYMER FIBERS AND PROCESS TO MAKE THE SAME

[75] Inventor: Bernard Cohen, Berkeley Lake, Ga.

[73] Assignee: Kimberly-Clark Corporation, Neenah, Wis.

[21] Appl. No.: 28,672

[22] Filed: Mar. 9, 1993

[51] Int. Cl.[5] ..... B32B 15/00

[52] U.S. Cl. ..... 428/285; 156/229; 428/283; 428/284; 428/286; 428/287; 428/246; 428/253; 428/297; 428/298; 428/903; 428/937; 428/938

[58] Field of Search ..... 428/283, 285, 286, 287, 428/284, 297, 298, 251, 252, 253, 903, 937, 938, 246; 156/84, 85, 229

[56] References Cited

U.S. PATENT DOCUMENTS

| | | | |
|---|---|---|---|
| 3,778,331 | 12/1973 | Scharf | 161/67 |
| 4,204,942 | 5/1980 | Chahroudi | 204/298 |
| 4,305,981 | 12/1981 | Muroi et al. | 428/31 |
| 4,366,202 | 12/1982 | Borovsky | 428/283 |
| 4,439,768 | 3/1984 | Ebneth et al. | 343/18 B |
| 4,508,776 | 4/1985 | Smith | 428/248 |
| 4,656,081 | 4/1987 | Ando et al. | 428/233 |
| 4,657,807 | 4/1987 | Fuerstman | 428/263 |
| 4,738,894 | 4/1988 | Borde | 428/283 |
| 4,765,323 | 8/1988 | Poettgen | 128/132 |
| 4,913,978 | 4/1990 | Klotz et al. | 428/551 |
| 4,933,129 | 6/1990 | Huykman | 264/116 |
| 4,965,098 | 10/1990 | Handa et al. | 428/203 |
| 4,965,122 | 10/1990 | Morman | 428/903 |
| 4,981,747 | 1/1991 | Morman | 428/903 |
| 4,999,222 | 3/1991 | Jones et al. | 427/250 |
| 5,055,338 | 10/1991 | Sheth et al. | 428/155 |
| 5,057,351 | 10/1991 | Jones et al. | 428/138 |
| 5,069,227 | 12/1991 | Maronian | 128/844 |
| 5,076,199 | 12/1991 | Kistrup | 118/52 |
| 5,113,874 | 5/1992 | Maronian | 128/844 |
| 5,114,781 | 5/1992 | Morman | 428/903 |
| 5,116,662 | 5/1992 | Morman | 428/903 |
| 5,122,412 | 6/1992 | Jones et al. | 428/296 |
| 5,135,797 | 8/1992 | Sasaki | 428/201 |
| 5,169,702 | 12/1992 | Schell | 428/102 |

FOREIGN PATENT DOCUMENTS 185480 of 0000 European Pat. Off. .
264771 of 0000 European Pat. Off. .

(List continued on next page.)

OTHER PUBLICATIONS

Japanese Abstract, vol. 9, No. 5 (C-260) (1728) 10 Jan. 1985 & JP-A-59 157 275 (Seikoo Kasei KK) 6 Sep. 1984 (Abstract).

Japanese Abstract, vol. 13, No. 24 (C-561) (3372) 19 Jan. 1989 & JP-A-63 227 761 (Hitachi Cable Ltd.) 22 Sep. 1988 (Abstract).

Japan Patent-JP 3019300 (Abstract).

"Plasma and Corona-Modified Polymer Surfaces", *Metallization of Polymers*, ACS Symposium Series 440, 1990, Chapter 5.

"Reactions of Metal Atoms with Monomers and Polymers", *Metallization of Polymers*, ACS Symposium Series 440, 1990, Chapter 18.

*Primary Examiner*—James J. Bell
*Attorney, Agent, or Firm*—Karl V. Sidor

[57] ABSTRACT

Disclosed is a stretchable metallized nonwoven web composed of at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and a metallic coating substantially covering at least a portion of at least one side of the nonwoven web. The nonwoven web of non-elastomeric thermoplastic polymer fibers can be a nonwoven web of non-elastomeric meltblown thermoplastic polymer fibers. The stretchable metallized nonwoven web may be joined with other materials to form multi-layer laminates. Also disclosed is a process of making a stretchable metallized nonwoven web.

20 Claims, 3 Drawing Sheets

FOREIGN PATENT DOCUMENTS

| | | |
|---|---|---|
| 0037235 | 10/1981 | European Pat. Off. . |
| 0076414 | 4/1983 | European Pat. Off. . |
| 0109167 | 5/1984 | European Pat. Off. . |
| 0239080 | 9/1987 | European Pat. Off. . |
| 0365692 | 5/1990 | European Pat. Off. . |
| 0185480 | 6/1990 | European Pat. Off. . |
| 0392082 | 10/1990 | European Pat. Off. . |
| 3925232 | of 0000 | Fed. Rep. of Germany . |
| 2345295 | of 0000 | France . |
| 1073077 | of 0000 | Japan . |
| 1171300 | of 0000 | Japan . |
| 1199771 | of 0000 | Japan . |
| 2101191 | of 0000 | Japan . |
| 2118173 | of 0000 | Japan . |
| 2235626 | of 0000 | Japan . |
| 2274869 | of 0000 | Japan . |
| 3011504 | of 0000 | Japan . |
| 3019300 | of 0000 | Japan . |
| 61132652 | of 0000 | Japan . |
| 61146869 | of 0000 | Japan . |
| 61146870 | of 0000 | Japan . |
| 62170581 | of 0000 | Japan . |
| 63024196 | of 0000 | Japan . |
| 63295762 | of 0000 | Japan . |
| 96401 | of 0000 | Romania . |
| 9004662 | 5/1990 | World Int. Prop. O. . |

STRETCHABLE METALLIZED NONWOVEN WEB OF NON-ELASTOMERIC THERMOPLASTIC POLYMER FIBERS AND PROCESS TO MAKE THE SAME

FIELD OF THE INVENTION

This invention relates to flexible metallized materials and a process to prepare flexible metallized materials.

BACKGROUND OF THE INVENTION

Metallic coatings ranging in thickness from less than a nanometer up to several microns have been added to sheet materials to provide a decorative appearance and/or various physical characteristics such as, for example, electrical conductivity, static charge resistance, chemical resistance, thermal reflectivity or emissivity, and optical reflectivity. In some situations, metallized sheet materials can be applied to or incorporated in some or all portions of a product instead of metallizing the product itself. This may be especially desirable for products that are, for example, large, temperature sensitive, vacuum sensitive, difficult to handle in a metallizing process, or have complex topographies.

In the past, such use of metallized sheet materials may have been restricted by the limitations of the substrate sheet. In the past, metallic coatings have typically been applied to sheet-like substrates that are considered to be relatively stretch-resistant and inelastic so that the substrate would not deform and cause the metallic coating to detach or flake off. Accordingly, such metallized materials may possess inadequate flexibility, stretch and recovery, softness and/or drape properties for many applications. For example, U.S. Pat. Nos. 4,999,222 and 5,057,351 describe metallized polyethylene plexifilamentary film-fibril sheets that are inelastic and have relatively poor drape and softness which may make them unsuited for applications where stretch and recovery, drape and softness are required. European Patent Publication 392,082-A2 describes a method of manufacturing a metallic porous sheet suitable for use as an electrode plate of a battery. According to that publication, metal may be deposited on a porous sheet (foam sheet, nonwoven web, mesh fabric or combinations of the same) utilizing processes such as vacuum evaporation, electrolytic plating and electroless plating.

Thus, a need exists for a stretchable metallized sheet material which has desirable flexibility, stretch and recovery, drape, and softness. There is a further need for a stretchable metallized sheet material which has the desired properties described above and which is so inexpensive that it can be discarded after only a single use. Although metallic coatings have been added to inexpensive sheet materials, such inexpensive metallized sheet materials have generally had limited application because of the poor flexibility, stretch and recovery, drape and softness of the original sheet material.

DEFINITIONS

As used herein, the terms "stretch" and "elongation" refer to the difference between the initial dimension of a material and that same dimension after the material is stretched or extended following the application of a biasing force. Percent stretch or elongation may be expressed as [(stretched length − initial sample length) / initial sample length] × 100. For example, if a material having an initial length of 1 inch is stretched 0.85 inch, that is, to a stretched or extended length of 1.85 inches, that material can be said to have a stretch of 85 percent.

As used herein, the term "recovery" refers to the contraction of a stretched or elongated material upon termination of a biasing force following stretching of the material from some initial measurement by application of the biasing force. For example, if a material having a relaxed, unbiased length of one (1) inch is elongated 50 percent by stretching to a length of one-and-one-half (1.5) inches, the material is elongated 50 percent (0.5 inch) and has a stretched length that is 150 percent of its relaxed length. If this stretched material contracts, that is, recovers to a length of one-and-one-tenth (1.1) inches after release of the biasing and stretching force, the material has recovered 80 percent (0.4 inch) of its one-half (0.5) inch elongation. Percent recovery may be expressed as [maximum stretch length − final sample length) / (maximum stretch length − initial sample length)] × 100.

As used herein, the term "non-recoverable stretch" refers to elongation of a material upon application of a biasing force which is not followed by a contraction of the material as described above for "recovery". Non-recoverable stretch may be expressed as a percentage as follows:

Non-recoverable stretch = 100 − recovery when the recovery is expressed in percent.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as fibers and/or filaments from a plurality of fine, usually circular, capillaries in a spinnerette with the diameter of the extruded fibers and/or filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultrafine microfibers may be found in, for example, U.S. patent application Ser. No. 07/779,929, entitled "A Nonwoven Web With Improved Barrier Properties", filed Nov. 26, 1991 now abandoned, incorporated herein by reference in its entirety.

As used herein, the term "thermoplastic material" refers to a high polymer that softens when exposed to heat and returns to its original condition when cooled to room temperature. Natural substances which exhibit this behavior are crude rubber and a number of waxes. Other exemplary thermoplastic materials include, without limitation, polyvinyl chloride, polyesters, nylons, polyfluorocarbons, polyethylene, polyurethane, polystyrene, polypropylene, polyvinyl alcohol, caprolactams, and cellulosic and acrylic resins.

As used herein, the term "disposable" is not limited to single use articles but also refers to articles that can be discarded if they become soiled or otherwise unusable after only a few uses.

As used herein, the term "machine direction" refers to the direction of travel of the forming surface onto which fibers are deposited during formation of a nonwoven web.

As used herein, the term "cross-machine direction" refers to the direction which is perpendicular to the machine direction defined above.

The term "α-transition" as used herein refers a phenomenon that occurs in generally crystalline thermoplastic polymers. The α-transition denotes the highest temperature transition below the melt transition ($T_m$) and is of ten ref erred to as pre-melting. Below the α-transition, crystals in a polymer are fixed. Above the α-transition, crystals can be annealed into modified structures. The α-transition is well known and has been described in such publications as, for example, Mechanical Properties of Polymers and Composites (Vol. 1) by Lawrence E. Nielsen; and Polymer Monographs, ed. H. Moraweitz, (Vol. 2 Polypropylene by H. P. Frank). Generally speaking, the α-transition is determined using Differential Scanning Calorimetry techniques on equipment such as, for example, a Mettler DSC 30 Differential Scanning Calorimeter. Standard conditions for typical measurements are as follows: Heat profile, 30° C. to a temperature about 30° C. above the polymer melt point at a rate of 10° C./minute; Atmosphere, Nitrogen at 60 Standard Cubic Centimeters (SCC)/minute; Sample size, 3 to 5 milligrams.

The expression "onset of melting at a liquid fraction of five percent" refers to a temperature which corresponds to a specified magnitude of phase change in a generally crystalline polymer near its melt transition. The onset of melting occurs at a temperature which is lower than the melt transition and is characterized by different ratios of liquid fraction to solid fraction in the polymer. The onset of melting is determined using Differential scanning calorimetry techniques on equipment such as, for example, a Mettler DSC 30 Differential Scanning Calorimeter. Standard conditions for typical measurements are as follows: Heat profile, 30° to a temperature about 30° C. above the polymer melt point at a rate of 10° C./minute; Atmosphere, Nitrogen at 60 Standard Cubic Centimeters (SCC)/minute; Sample size, 3 to 5 milligrams.

As used herein, the term "neckable material" means any material which can be necked.

As used herein, the term "necked material" refers to any material which has been constricted in at least one dimension by processes such as, for example, drawing.

As used herein, the term "stretch direction" refers to the direction of stretch and recovery.

As used herein, the term "percent neck-down" refers to the ratio determined by measuring the difference between the pre-necked dimension and the necked dimension of a neckable material and then dividing that difference by the pre-necked dimension of the neckable material; this quantity multiplied by 100. For example, the percent neck-down may be represented by the following expression:

percent neck-down = [(pre-necked dimension-necked dimension)/pre-necked dimension] × 100

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, surfactants, waxes, flow promoters, particulates and materials added to enhance processability of the composition.

SUMMARY OF THE INVENTION

The present invention addresses the above-described problems by providing a stretchable metallized nonwoven web composed of at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and a metallic coating covering substantially at least a portion of at least one side of the nonwoven web.

The nonwoven web of non-elastomeric thermoplastic polymer fibers may be a nonwoven web of meltblown fibers, a bonded-carded web, or a spun-bonded web. The nonwoven web of meltblown fibers may include meltblown microfibers. For example, at least about 50 percent, as determined by optical image analysis, of the meltblown microfibers have an average diameter of less than 5 microns.

It is contemplated that embodiments of the stretchable metallized nonwoven web of the present invention may be manufactured so inexpensively that it may be economical to dispose of the materials after a limited period of use.

According to the present invention, the stretchable metallized nonwoven web may have a basis weight ranging from about 6 to about 400 grams per square meter. For example, the stretchable metallized nonwoven web may have a basis weight ranging from about 30 to about 250 grams per square meter. More particularly, the stretchable metallized nonwoven web may have a basis weight ranging from about 35 to about 100 grams per square meter.

In one aspect of the present invention, the non-elastomeric thermoplastic polymer fibers may be formed from a polymer selected from polyolefins, polyesters, and polyamides. More particularly, the polyolefins may be, for example, one or more of polyethylene, polypropylene, polybutene, ethylene copolymers, propylene copolymers, and butene copolymers.

According to one embodiment of the invention, where the non-elastic thermoplastic polymer fibers are meltblown fibers, meltblown fibers may be mixed with one or more other materials such as, for example, wood pulp, textile fibers, and particulates. Exemplary textile fibers include polyester fibers, polyamide fibers, glass fibers, polyolefin fibers, cellulosic derived fibers, multicomponent fibers, natural fibers, absorbent fibers, electrically conductive fibers or blends of two or more of such fibers. Exemplary particulates include activated charcoal, clays, starches, metal oxides, super-absorbent materials and mixtures of such materials.

Generally speaking, the thickness of the metallic coating on the nonwoven web may range from about 1 nanometer to about 5 microns. For example, the thickness of the metallic coating may range from about 5 nanometers to about 1 micron. More particularly, the thickness of the metallic coating may range from about 10 nanometers to about 500 nanometers.

Generally speaking, the stretchable metallized nonwoven web retains much of its metallic coating when stretched in a direction generally parallel to neck-down at least about 25 percent. That is, there is little or no flaking or loss of metal observable to the unaided eye when a stretchable metallized nonwoven web of non-elastomeric thermoplastic polymer fibers of the present invention covered with at least at low to moderate levels of metallic coating is subjected to normal handling.

The metallic coating may cover substantially all of one or both sides of the stretchable nonwoven web or the metallic coating may be limited to portions of one or both sides of the stretchable nonwoven web. For example, the stretchable nonwoven web may be masked during the metal coating process to produce discrete portions of stretchable metallized nonwoven web. One or more layers of the same or different metals may be coated onto the nonwoven web. The coating may be any metal or metallic alloy which can be deposited onto a stretchable nonwoven web of non-elastomeric thermoplastic polymer fibers and which bonds to the web to form a durable coating. Exemplary metals include aluminum, copper, tin, zinc, lead, nickel, iron, gold, silver and the like. Exemplary metallic alloys include copper-based alloys, aluminum based alloys, titanium based alloys, and iron based alloys. Conventional fabric finishes may be applied to the stretchable metallized nonwoven web. For example, lacquers, shellacs, sealants and/or polymers may be applied to the stretchable metallized nonwoven web.

The present invention encompasses multilayer materials which contain at least one layer which is a stretchable metallized nonwoven web. For example, a stretchable metallized nonwoven web of meltblown fibers may be laminated with one or more webs of spunbonded filaments. The stretchable metallized nonwoven web may even be sandwiched between other layers of materials.

According to the present invention, a stretchable metallized nonwoven web may be made by a process which includes the following steps: (1) providing at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and (2) metallizing at least one portion of at least one side of the nonwoven web so that portion is substantially covered with a metallic coating.

The metallizing of the nonwoven web may be accomplished by any process which can be used to deposit metal onto a nonwoven web and which bonds the metal to the nonwoven web. The metallizing step may be carried out by techniques such as metal vapor deposition, metal sputtering, plasma treatments, electron beam treatments or other treatments which deposit metals. Alternatively and/or additionally, the fibers may be covered with certain compounds which can be chemically reacted (e.g., via a reduction reaction) to produce a metallic coating. Before the metallic coating is added to the nonwoven web, the surface of the web and/or individual fibers may be modified utilizing techniques such as, for example, plasma discharge or corona discharge treatments. According to one embodiment of the process of the present invention, the nonwoven web of non-elastomeric thermoplastic polymer fibers, for example, a nonwoven web of non-elastomeric meltblown fibers, may be calendered or bonded either before or after the metallizing step.

DETAILED DESCRIPTION OF THE INVENTION

Figure 1:
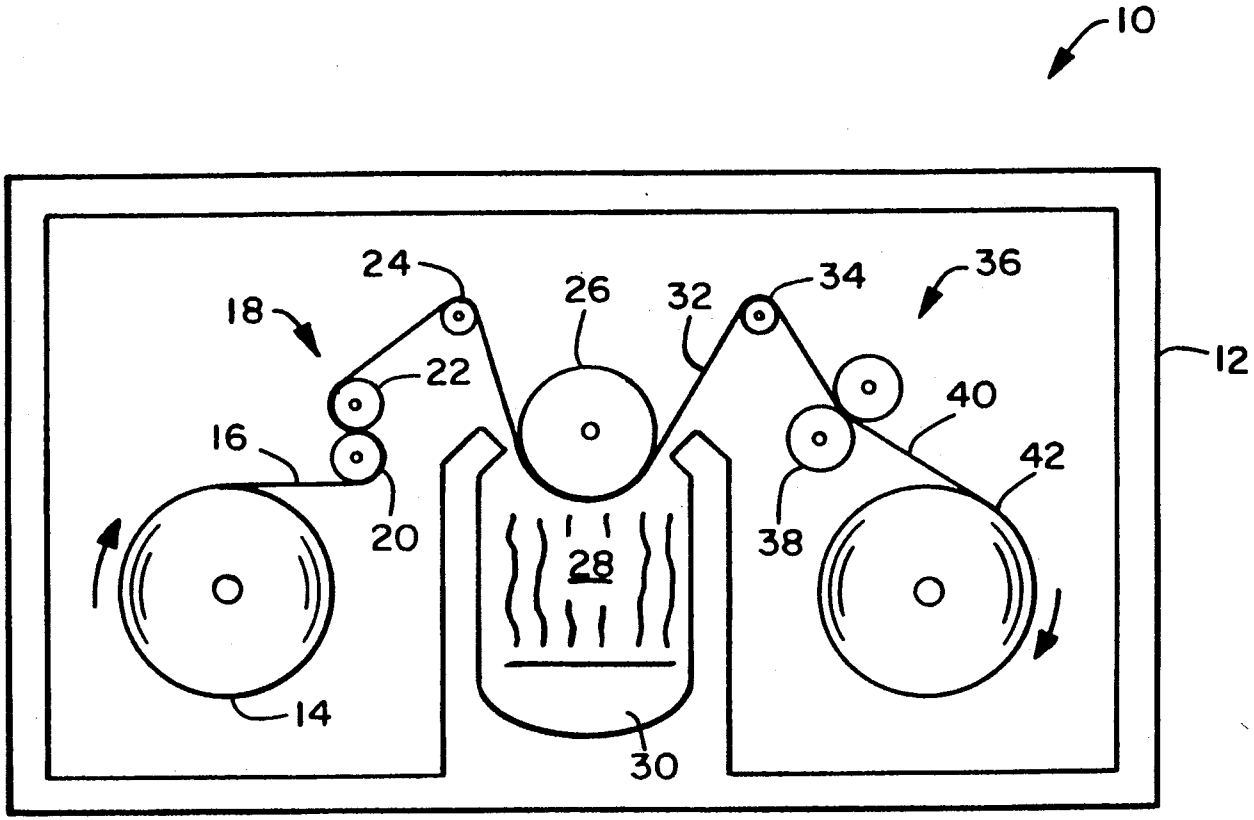
FIG. 1 is an illustration of an exemplary process for making a stretchable metallized nonwoven web of non-elastomeric thermoplastic polymer fibers.

Referring to the drawings and in particular to FIG. 1, there is shown at 10 an exemplary process of making the stretchable metallized nonwoven web of non-elastomeric thermoplastic polymer fibers of the present invention within an evacuated chamber 12. Metal vapor deposition typically takes place in the evacuated chamber 12 at an absolute pressure from about $10^{-6}$ to about $10^{-4}$ Torr (i.e, millimeters of Hg (mercury)). A supply roll 14 of a stretchable nonwoven web of non-elastomeric thermoplastic polymer fibers 16 located within the evacuated chamber 12 is unwound. The nonwoven web 16 travels in the direction indicated by the arrow associated therewith as the supply roll 14 rotates in the direction of the arrow associated therewith. The nonwoven web 16 passes through a nip of an S-roll arrangement 18 formed by two stack rollers 20 and 22. It is contemplated that the nonwoven web of non-elastomeric thermoplastic polymer fibers may be formed by web forming processes such as, for example, meltblowing processes or spunbonding processes, be heated treated to have stretch and recovery properties and then passed directly through the nip of the S-roll arrangement 18 without first being stored on a supply roll.

From the reverse S path of the S-roll arrangement 18, the nonwoven web 16 passes over an idler roller 24 and then contacts a portion of a chill roll 26 while it is exposed to metal vapor 28 emanating from a molten metal bath 30. Metal vapor condenses on the nonwoven web 16 forming a stretchable metallized nonwoven web 32. Although a chill roll 26 is not required to practice the present invention, it has been found to be useful in some situations to avoid physical deterioration of the nonwoven web 16 during exposure to the metal vapor 28 and/or to minimize deterioration of the stretch and recovery properties imparted to the nonwoven web during heat treatment. For example, a chill roll would be desirable when the nonwoven web is exposed to the metal vapor for a relatively long period. Multiple metal baths and chill roll arrangements (not shown) may be used in series to apply multiple coatings of the same or different metals. Additionally, the present invention is meant to encompass other types of metallizing processes such as, for example, metal sputtering, electron beam metal vapor deposition and the like. Metal may also be deposited on the nonwoven web by means of a chemical reaction such as, for example, a chemical reduction reaction. Generally speaking, any process which deposits metal on the nonwoven web with minimal deterioration of the nonwoven web and its stretch and recovery properties may be employed. The metallizing processes described above may be used in combination in the practice of the present invention.

The metallic coating substantially covers at least a portion of at least one side of the nonwoven web 16. For example, the metallic coating may substantially cover all of one or both sides of the nonwoven web 16. The nonwoven web 16 may be masked with one or more patterns during exposure to the metal vapor 28 so that only desired portions of one or both sides of the nonwoven web have a metallic coating.

The stretchable metallized nonwoven web 32 passes over an idler roller 34 and through nip of a drive roller arrangement 36 formed by two drive rollers 38 and 40. The peripheral linear speed of the rollers of the S-roll arrangement 18 is controlled to be about the same as the peripheral linear speed of the rollers of the drive roller arrangement 36 so that tension generated in the nonwoven web 16 between the S-roll arrangement 18 and the drive roller arrangement 36 is sufficient to carry out the process and maintain the nonwoven web 16 in a necked condition.

The stretchable metallized nonwoven web 32 passes through the S-roll arrangement 18 and the bonder roll arrangement 36 and then the stretchable metallized nonwoven web 32 is wound up on a winder 42.

Conventional fabric post-treatments may be applied to the stretchable metallized nonwoven web provided they do not harm the metallic coating. For example, shellacs, lacquers, sealants and/or sizing may be applied. Alternatively and/or additionally, a polymer coating such as, for example, a polyurethane coating, may be applied to the stretchable metallized nonwoven web.

Generally speaking, the nonwoven web of non-elastomeric thermoplastic polymer fibers may be any nonwoven web which can be heat treated to impart stretch and recovery properties. Exemplary webs include bonded carded webs, nonwoven webs of meltblown fibers and spunbonded filament webs. Desirably, the nonwoven web of non-elastomeric thermoplastic polymer fibers is a nonwoven web of meltblown fibers.

Figure 2:
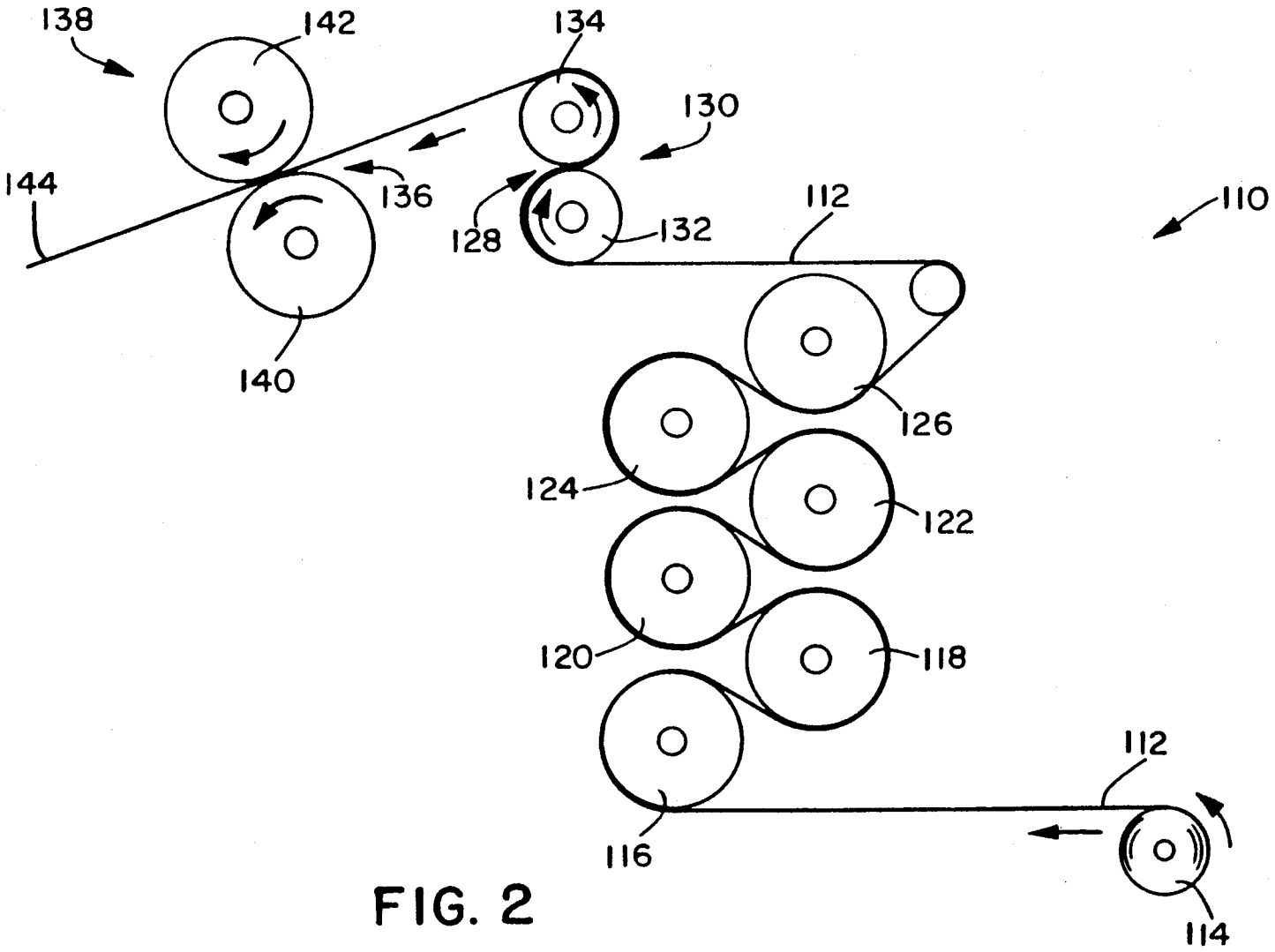
FIG. 2 is an illustration of an exemplary process for making a stretchable nonwoven web of non-elastomeric thermoplastic polymer fibers.

Referring to FIG. 2 of the drawings there is schematically illustrated at 110 an exemplary process for making a nonwoven web of non-elastomeric thermoplastic polymer fibers having stretch and recovery properties. FIG. 2 depicts a process in which the nonwoven web of non-elastomeric thermoplastic polymer fibers is subjected to a heat treatment utilizing a series of heated drums.

In FIG. 2, a nonwoven neckable material 112 is unwound from a supply roll 114 and travels in the direction indicated by the arrow associated therewith as the supply roll 114 rotates in the direction of the arrows associated therewith.

The nonwoven neckable material 112 may be formed by one or more meltblowing processes and passed directly to a heated drum 116 without first being stored on a supply roll 114.

The neckable material 112 passes over a series of heated drums (e.g., steam cans) 116–126 in a series of reverse S-loops. The steam cans 116–126 typically have an outside diameter of about 24 inches although other sized cans may be used. The contact time or residence time of the neckable material on the steam cans to effect heat treatment will vary depending on factors such as, for example, steam can temperature, type and/or basis weight of material, and diameter of the meltblown fibers in the material. The contact time should be sufficient to heat the nonwoven neckable material 112 to a temperature at which the peak total energy absorbed by the neckable material is at least about 250 percent greater than the amount absorbed by the neckable material 112 at room temperature. For example, the contact time should be sufficient to heat the nonwoven neckable material 112 to a temperature at which the peak total energy absorbed by the neckable material is at least about 275 percent greater than the amount absorbed by the neckable material at room temperature. As a further example, the neckable material can be heated to a temperature at which the peak total energy absorbed by the neckable material is from about 300 percent greater to more than about 1000 percent greater than the amount absorbed by the neckable material at room temperature.

Generally speaking, when the nonwoven neckable material 112 is a nonwoven web of meltblown thermoplastic polymer fibers formed from a polyolefin such as, for example, polypropylene, the residence time on the steam cans should be sufficient to heat the meltblown fibers to a temperature ranging from greater than the polymer's $\alpha$-transition to about 10 percent below the onset of melting at a liquid fraction of 5 percent.

For example, a nonwoven web of meltblown polypropylene fibers may be passed over a series of steam cans heated to a measured surface temperature from about 90° to about 150° C. (194°–302° F.) for a contact time of about 1 to about 300 seconds to provide the desired heating of the web. Alternatively and/or additionally, the nonwoven web may be heated by infra-red radiation, microwaves, ultrasonic energy, flame, hot gases, hot liquids and the like. For example, the nonwoven web may be passed through a hot oven.

Although the inventors should not be held to a particular theory, it is believed that heating a nonwoven web of meltblown thermoplastic non-elastomeric, generally crystalline polymer fibers to a temperature greater than the polymer's $\alpha$-transition before applying tension is important. Above the $\alpha$-transition, crystals in the polymer fibers can be annealed into modified structures which, upon cooling in fibers held in a tensioned configuration, enhance the stretch and recovery properties (e.g., recovery from application of a stretching force) of a nonwoven web composed of such fibers. It is also believed that the meltblown fibers should not be heated to a temperature greater than the constituent polymer's onset of melting at a liquid fraction of five (5) percent. Desirably, this temperature should be more than ten (10) percent below the temperature determined for the polymer's onset of melting at a liquid fraction of 5 percent. One way to roughly estimate a temperature approaching the upper limit of heating is to multiply the polymer melt temperature (expressed in degrees Kelvin) by 0.95.

Importantly, it is believed that heating the meltblown fibers within the specified temperature range permits the fibers to become bent, extended and/or drawn during necking rather than merely slipping over one another in response to the tensioning force.

From the steam cans, the heated neckable material 112 passes through the nip 128 of an S-roll arrangement 130 in a reverse-S path as indicated by the rotation direction arrows associated with the stack rollers 132 and 134. From the S-roll arrangement 130, the heated neckable material 112 passes through the nip 136 of a drive roller arrangement 138 formed by the drive rollers 140 and 142. Because the peripheral linear speed of the rollers of the S-roll arrangement 130 is controlled to be less than the peripheral linear speed of the rollers of the drive roller arrangement 138, the heated neckable material 102 is tensioned between the S-roll arrangement 130 and the nip of the drive roll arrangement 138. By adjusting the difference in the speeds of the rollers, the heated neckable material 112 is tensioned so that it necks a desired amount and is maintained in such tensioned, necked condition while it is cooled. Other factors affecting the neck-down of the heated neckable material are the distance between the rollers applying the tension, the number of drawing stages, and the total length of heated material that is maintained under tension. Cooling may be enhanced by the use of a cooling fluid such as, for example, chilled air or a water spray.

Generally speaking, the difference in the speeds of the rollers is sufficient to cause the heated neckable material 112 to neck-down to a width that is at least about 10 percent less than its original width (i.e., before application of the tensioning force) . For example, the heated neckable material 112 may be necked-down to a width that is from about 15 percent to about 50 percent less than its original width.

The present invention contemplates using other methods of tensioning the heated neckable material 112. For example, tenter frames or other cross-machine direction stretcher arrangements that expand the neckable material 112 in other directions such as, for example, the cross-machine direction so that, upon cooling, the resulting material 144 will have stretch and recovery properties in a direction generally parallel to the direction that the material is necked. It is also contemplated that web-formation, neck-down and heat treatment can be accomplished in-line with the metallization step. Alternatively and/or additionally, it is contemplated that the heat treatment step may use heat from the molten metal bath to accomplish or assist the heat treatment of the necked-down nonwoven web. Other techniques may be used to impart stretch and recovery properties to a nonwoven web of non-elastomeric thermoplastic polymer fibers. For example, a technique in which a nonwoven web of non-elastomeric thermoplastic polymer fibers is necked-down and then heat treated is disclosed in, for example, U.S. Pat. No. 4,965,122, entitled "Reversibly Necked Material", the contents of which are incorporated herein by reference.

An important feature of the present invention is that a metallic coating is deposited onto a nonwoven web of non-elastomeric thermoplastic polymer fibers that has been treated to have stretch and recovery properties. For example, it is generally thought that a nonwoven web of meltblown polypropylene fibers and/or meltblown polypropylene microfibers tends to resist necking because of its highly entangled fine fiber network. It is this same highly entangled network that is permeable to air and water vapor and yet is relatively impermeable to liquids and/or particulates while providing an excellent surface for depositing a metallic coating.

In one aspect of the present invention, the continuity of the metallic coating on the highly entangled network of meltblown fibers creates a nonwoven web that is electrically conductive while also maintaining stretch and recovery properties.

Gross changes in this fiber network such as rips or tears would limit and may destroy the conductivity of the stretchable metallized nonwoven web of meltblown non-elastomeric thermoplastic polymer fibers. Unfortunately, because they are relatively unyielding and resist necking, highly entangled networks of non-elastic meltblown fibers respond poorly to stretching forces and tend to rip or tear.

However, by heating the meltblown fiber web as described above, necking the heated material and then cooling it, a useful level of stretch and recovery, at least in the direction parallel to neck-down, can be imparted to this web. This characteristic is believed to be useful in maintaining the electrical conductivity of the nonwoven web, especially when the web is subjected to stretching forces in the direction parallel to neck-down.

Thus, the stretchable metallized nonwoven webs of the present invention can combine electrical conductivity with an ability to stretch in a direction generally parallel to neck-down at least about 10 percent more than an identical untreated nonwoven web and recover at least about 50 percent when stretched that amount. As an example, the stretchable metallized nonwoven web may be adapted to stretch in a direction generally parallel to neck-down from about 15 percent to about 60 percent and recover at least about 70 percent when stretched 60 percent. As another example, the stretchable metallized nonwoven web may be adapted to stretch in a direction generally parallel to neck-down from about 20 percent to about 30 percent and recover at least about 75 percent when stretched 30 percent. As yet another example, the stretchable metallized nonwoven webs of the present invention web may be electrically conductive and have the ability to stretch in a direction generally parallel to neck-down from about 15 percent to about 60 percent more than an identical untreated nonwoven web and recover at least about 50 percent when stretched 60 percent. Desirably, the stretchable metallized nonwoven web may be adapted to remain electrically conductive when stretched in a direction generally parallel to neck-down at least about 25 percent. More desirably, the stretchable metallized nonwoven web may be adapted to remain electrically conductive when stretched in a direction generally parallel to neck-down from about 30 percent to about 100 percent or more. It is contemplated that the stretchable metallized nonwoven webs of the present invention may, alternatively and/or additionally to being electrically conductive, have other characteristics such as, for example, thermal resistivity (e.g., insulative properties), chemical resistance, weatherability and abrasion resistance. For example, the metal coating may be used to impart light (e.g., ultraviolet light) stability to nonwoven webs made from light (e.g., ultraviolet light) sensitive polymers such as, for example, polypropylene.

Furthermore, the stretchable metallized nonwoven webs of the present invention may have a porosity exceeding about 15 $ft^3/min/ft^2$ (CFM/ $ft^2$). For example, the stretchable metallized nonwoven webs may have a porosity ranging from about 30 to about 250 $CFM/ft^2$ or greater. As another example, the stretchable metallized nonwoven webs may have a porosity ranging from about 75 to about 170 $CFM/ft^2$. Such levels of porosity permit the stretchable metallized nonwoven webs of the present invention to be particularly useful in applications such as, for example, workwear garments.

Desirably, the stretchable metallized nonwoven webs have a basis weight of from about 6 to about 400 grams per square meter. For example, the basis weight may range from about 10 to about 150 grams per square meter. As another example, the basis weight may range from about 20 to about 90 grams per square meter.

The stretchable metallized nonwoven webs of the present invention may also be joined to one or more layers of another material to form a multi-layer laminate. The other layers may be, for example, woven fabrics, knit fabrics, bonded carded webs continuous filaments webs (e.g., spunbonded filament webs), meltblown fiber webs, and combinations thereof.

Generally, any suitable non-elastomeric thermoplastic polymer fiber forming resins or blends containing the same may be utilized to form the nonwoven webs of non-elastomeric thermoplastic polymer fibers employed in the invention. The present invention may be practiced utilizing polymers such as, for example, polyolefins, polyesters and polyamides. Exemplary polyolefins include one or more of polyethylene, polypropylene, polybutene, ethylene copolymers, propylene copolymers and butene copolymers. Polypropylenes that have been found useful include, for example, polypropylene available from the Himont Corporation under the trade designation PF-015 and polypropylene available from the Exxon Chemical Company under the trade designation Exxon 3445G. Chemical characteristics of these materials are available from their respective manufacturers.

The nonwoven web of meltblown fibers may be formed utilizing conventional meltblowing processes. Desirably, the meltblown fibers of the nonwoven web will include meltblown microfibers to provide enhanced barrier properties and/or a better surface for metallization. For example, at least about 50 percent, as determined by optical image analysis, of the meltblown microfibers may have an average diameter of less than about 5 microns. As yet another example, at least about 50 percent of the meltblown fibers may be ultra-fine microfibers that may have an average diameter of less than about 3 microns. As a further example, from about 60 percent to about 100 percent of the meltblown microfibers may have an average diameter of less than 5 microns or may be ultra-fine microfibers. An example of an ultra-fine meltblown microfiber web may be found in previously reference, U.S. patent application Ser. No. 07/779,929, entitled "A Nonwoven Web With Improved Barrier Properties", filed Nov. 26, 1991. The present invention also contemplates that the nonwoven web may be, for example, an anisotropic nonwoven web. Disclosure of such a nonwoven web may be found in U.S. patent application Ser. No. 07/864,808 entitled "Anisotropic Nonwoven Fibrous Web", filed Apr. 7, 1992, the entire contents of which is incorporated herein by reference.

The nonwoven web may also be a mixture of meltblown fibers and one or more other materials. As an example of such a nonwoven web, reference is made to U.S. Pat. Nos. 4,100,324 and 4,803,117, the contents of each of which are incorporated herein by reference in their entirety, in which meltblown fibers and other materials are commingled to form a single coherent web of randomly dispersed fibers and/or other materials. Such mixtures may be formed by adding fibers and/or particulates to the gas stream in which meltblown fibers are carried so that an intimate entangled commingling of the meltblown fibers and other materials occurs prior to collection of the meltblown fibers upon a collection device to form a coherent web of randomly dispersed meltblown fibers and other materials. Useful materials which may be used in such nonwoven composite webs include, for example, wood pulp fibers, textile and/or staple length fibers from natural and synthetic sources (e.g., cotton, wool, asbestos, rayon, polyester, polyamide, glass, polyolefin, cellulose derivatives and the like), multi-component fibers, absorbent fibers, electrically conductive fibers, and particulates such as, for example, activated charcoal/carbon, clays, starches, metal oxides, super-absorbent materials and mixtures of such materials. Other types of nonwoven composite webs may be used. For example, a hydraulically entangled nonwoven composite web may be used such as disclosed in U.S. Pat. Nos. 4,931,355 and 4,950,531 both to Radwanski, et al., the contents of which are incorporated herein by reference in their entirety.

If the stretchable metallized nonwoven web of non-elastomeric thermoplastic polymer fibers is a nonwoven web of meltblown fibers, the meltblown fibers may range, for example, from about 0.1 to about 100 microns in diameter. However, if barrier properties are important in the stretchable metallized nonwoven web (for example, if it is important that the final material have increased opacity and/or insulation and/or dirt protection and/or liquid repellency) then finer fibers which may range, for example, from about 0.05 to about 20 microns in diameter can be used.

The nonwoven web of non-elastomeric thermoplastic polymer fibers may be pre-treated before the metallizing step. For example, the nonwoven web may be calendered with a flat roll, point bonded, pattern bonded or even saturated in order to achieve desired physical and/or textural characteristics. It is contemplated that liquid and/or vapor permeability may be modified by flat thermal calendering or pattern bonding some types of nonwoven webs. Additionally, at least a portion of the surface of the individual fibers or filaments of the nonwoven web may be modified by various known surface modification techniques to alter the adhesion of the metallic coating to the non-elastomeric thermoplastic polymer fibers. Exemplary surface modification techniques include, for example, chemical etching, chemical oxidation, ion bombardment, plasma treatments, flame treatments, heat treatments, and corona discharge treatments.

One important feature of the present invention is that the stretchable metallized nonwoven web is adapted to retain much of its metallic coating when stretched in a direction generally parallel to neck-down at least about 15 percent. That is, there is little or no flaking or loss of metal observable to the unaided eye when a stretchable metallized nonwoven web of the present invention covered with at least at low to moderate levels of metallic coating is subjected to normal handling. For example, a stretchable metallized nonwoven web having a metallic coating from about 5 nanometers to about 500 nanometers may be adapted to retain much of its metallic coating when stretched in a direction generally parallel to neck-down from about 25 percent to more than 50 percent (e.g., 65 percent or more). More particularly, such a stretchable metallized nonwoven web may be adapted to retain much of its metallic coating when stretched in a direction generally parallel to neck-down from about 35 percent to about 75 percent.

The thickness of the deposited metal depends on several factors including, for example, exposure time, the pressure inside the evacuated chamber, temperature of the molten metal, surface temperature of the nonwoven web, size of the metal vapor "cloud", and the distance between the nonwoven web and molten metal bath, the number of passes over through the metal vapor "cloud", and the speed of the moving web. Generally speaking, lower process speeds tend to correlate with heavier or thicker metallic coatings on the nonwoven web but lower speeds increase the exposure time to metal vapor under conditions which may deteriorate the nonwoven web. Under some process conditions, exposure times can be less than about 1 second, for example, less than about 0.75 seconds or even less than about 0.5 seconds. Generally speaking, any number of passes through the metal vapor "cloud" may be used to increase the thickness of the metallic coating.

The nonwoven web is generally metallized to a metal thickness is ranging from about 1 nanometer to about 5 microns. Desirably, the thickness of the metallic coating may range from about 5 nanometers to about 1 micron. More particularly, the thickness of the metallic coating may be from about 10 nanometers to about 500 nanometers.

Any metal which is suitable for physical vapor deposition or metal sputtering processes may be used to form metallic coatings on the nonwoven web. Exemplary metals include aluminum, copper, tin, zinc, lead, nickel, iron, gold, silver and the like. Exemplary metallic alloys include copper-based alloys (e.g., bronze, monel, cupronickel and aluminum-bronze) ; aluminum based alloys (aluminum-silicon, aluminum-iron, and their ternary relatives) ; titanium based alloys; and iron based alloys. Useful metallic alloys include magnetic materials (e.g., nickel-iron and aluminum-nickel-iron) and corrosion and/or abrasion resistant alloys.

Figure 3:
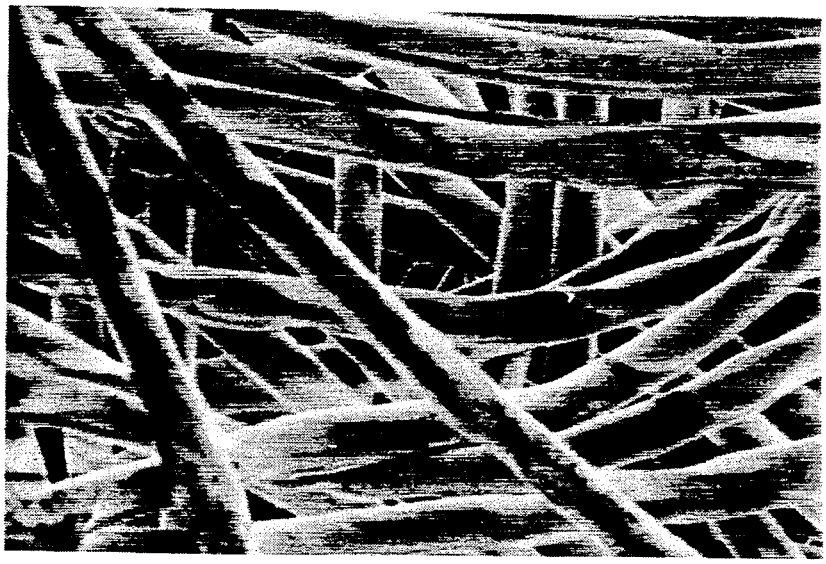
FIG. 3 is a microphotograph of an exemplary stretchable metallized nonwoven web of non-elastomeric thermoplastic polymer fibers.
Figure 4:
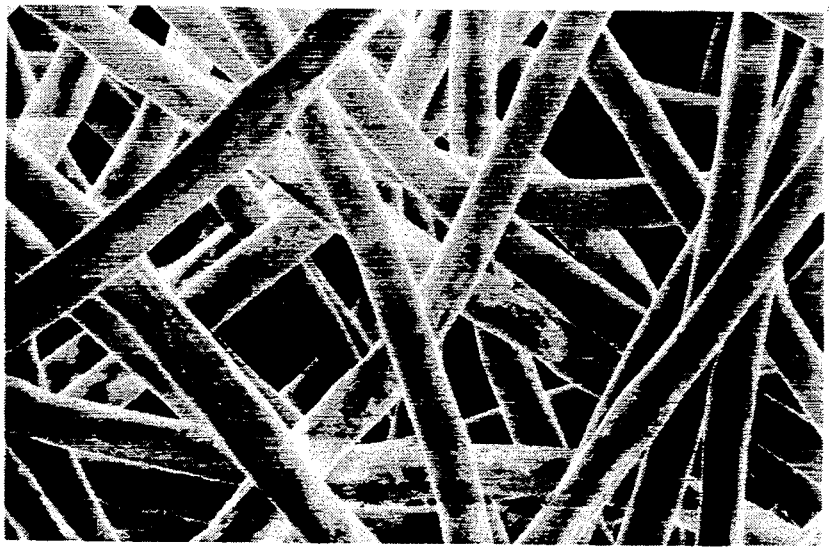
FIG. 4 is a microphotograph of an exemplary stretchable metallized nonwoven web of non-elastomeric thermoplastic polymer fibers.

FIGS. 3 and 4 are scanning electron microphotographs of an exemplary stretchable metallized nonwoven web of the present invention. The stretchable metallized nonwoven web shown in FIGS. 3 and 4 was made from a 51 gsm nonwoven web of spunbonded polypropylene fiber/filaments formed utilizing conventional spunbonding process equipment. Stretch and recovery properties were imparted to the nonwoven web of meltblown polypropylene fibers by passing the web over a series of steam cans to the nonwoven web to a temperature of about 110° Centigrade for a total contact time of about 10 seconds; applying a tensioning force to neck the heated nonwoven web about 30 percent (i.e., a neck-down of about 30 percent); and cooling the necked nonwoven web. The stretch and recovery properties of the materials are in a direction generally parallel to the direction of neck-down.

A metal coating was added to the webs utilizing conventional techniques. The scanning electron microphotographs were obtained directly from the metal coated nonwoven web without the pre-treatment conventionally used in scanning electron microscopy.

More particularly, FIG. 3 is a 401× (linear magnification) microphotograph of a stretchable metallized nonwoven spunbonded polypropylene fiber/filament web with a metallic aluminum coating. The sample was metallized while it was in the unstretched condition and is shown in the microphotograph in the unstretched condition.

FIG. 4 is a 401× (linear magnification) microphotograph of the material shown in FIG. 3 after the material has been subjected to 5 cycles of stretching to about 25 percent and recovery. The sample shown in the microphotograph is in unstretched condition.

EXAMPLE

A stretchable metallized nonwoven web material was made by depositing a metallic coating onto a nonwoven web of spunbonded polypropylene fibers/filaments which was subjected to heat treatment to impart stretch and recovery properties to the nonwoven web. The nonwoven web was a nonwoven web of polypropylene filaments formed utilizing conventional spunbonding techniques from Exxon 3445 polypropylene available from the Exxon Chemical Company. That material was heated to 230° F. (110° C.) and then necked-down about 30 percent to make the stretchable nonwoven web. An aluminum metal coating was deposited utilizing conventional metal deposition techniques.

In particular, a sample of a stretchable nonwoven web of polypropylene spunbonded filaments having a basis weight of about 51 gsm and measuring about 7 inches by 7 inches was coated with aluminum metal utilizing a conventional small scale vacuum metallizing process. This sample was placed in a Denton Vacuum DV502A vapor deposition apparatus available from Denton Vacuum Corporation of Cherry Hill, N.J. The sample was held in a rotating brace at the top of the bell jar in the vacuum apparatus. The chamber was evacuated to a pressure of less than about $10^{-5}$ Torr (i.e., millimeters of Hg). Electrical current was used to evaporate an aluminum wire (99+% aluminum, available from the Johnson Mathey Electronics Corp., Ward Hill, Mass.) to produce metal vapor inside the vacuum chamber. The procedure could be viewed through the bell jar. A metallic coating was deposited on one side of the stretchable nonwoven web. The web was turned over and the process was repeated to coat the other side of the web. The thickness of the aluminum coating was measured as 4.5K°A (4,500 Angstroms) on each side utilizing a Denton Vacuum DTM-100 thickness monitor also available from the Denton Vacuum Corporation of Cherry Hill, N.J. Various properties of the stretchable metallized nonwoven web were measured as described below.

The drape stiffness was determined using a stiffness tester available from Testing Machines, Amityville, Long Island, N.Y. 11701. Test results were obtained in accordance with ASTM standard test D1388-64 using the method described under Option A (Cantilever Test).

The basis weight of each stretchable metallized nonwoven web sample was determined essentially in accordance with Method 5041 of Federal Test Method Standard No. 191A.

The air permeability or "porosity" of the stretchable metallized nonwoven web was determined utilizing a Frazier Air Permeability Tester available from the Frazier Precision Instrument Company. The Frazier porosity was measured in accordance with Federal Test Method 5450, Standard No. 191A, except that the sample size was 8"×8" instead of 7"×7".

The electrical conductivity of the stretchable metallized nonwoven web was determined utilizing a Sears digital multitester Model 82386 available from Sears Roebuck & Company, Chicago, Ill. Probes were placed from about 0.5 to about 1 inch apart and conductivity was indicated when the meter showed a reading of zero resistance.

Peak load, peak total energy absorbed and peak elongation measurements of the stretchable metallized nonwoven web were made utilizing an Instron Model 1122 Universal Test Instrument essentially in accordance with Method 5100 of Federal Test Method Standard No. 191A. The sample width was 3 inches, the gage length was 4 inches and the cross-head speed was set at 12 inches per minute.

Peak load refers to the maximum load or force encountered while elongating the sample to break. Measurements of peak load were made in the machine and cross-machine directions. The results are expressed in units of force ($grams_{force}$) for samples that measured 3 inches wide by about 7 inches long using a gage length of 4 inches.

Elongation refers to a ratio determined by measuring the difference between a nonwoven web's initial unextended length and its extended length in a particular dimension and dividing that difference by the nonwoven web's initial unextended length in that same dimension. This value is multiplied by 100 percent when elongation is expressed as a percent. The peak elongation is the elongation measured when the material has been stretched to about its peak load.

Peak total energy absorbed refers to the total area under a stress versus strain (i.e., load vs. elongation) curve up to the point of peak or maximum load. Total energy absorbed is expressed in units of work/(length)$^2$ such as, for example, (inch . $lbs_{force}$)/(inch)$^2$.

When the stretchable metallized nonwoven web was removed from the vacuum chamber, there was little or no flaking or loss of metal observable to the unaided eye during normal handling. The stretchable metallized nonwoven web was examined by scanning electron microscopy both before and after five (5) cycles of being stretched in the direction parallel to neck-down at a rate of about 0.1 inches per minute to about 25 percent stretch and then recovering to about its initial necked-down dimensions. Scanning electron microphotographs of this material is shown in FIGS. 3 and 4.

The following properties were measured for the stretchable nonwoven web of spunbonded polypropylene filaments that was metallized as described above and for an un-metallized control sample of the same stretchable nonwoven web of spunbonded polypropylene filaments: Peak Load, Peak Total Energy Absorbed, Frazier Porosity, Elongation, and Basis Weight. The results are identified for measurements taken in the machine direction (MD) and the cross-machine direction (CD) where appropriate. Results of these measurements are reported in Table 1. It should be noted that a sufficient number of control webs were tested to be able to measure the standard deviation of most of the test results. Although a standard deviation was not determined for test results of the metallized web, it is believed that the standard deviation should be similar.

TABLE 1

| | | Stretchable Control Web | Stretchable Metallized Web |
|---|---|---|---|
| Basis Weight (gsm) | | 51 | 51 |
| Frazier Porosity (cfm/ft$^2$) | | 155.3 | 150.4 |
| Peak Total Energy Absorbed (inch-lbs/in.$^2$) | (MD) | 0.797 ± 0.208 | 0.863 |
| | (CD) | 1.319 ± 0.472 | 0.808 |
| Peak Load, $grams_{force}$ | (MD) | 23.786 ± 2.122 | 24.367 |
| | (CD) | 15.103 ± 1.514 | 14.071 |
| Peak Elongation, (percent) | (MD) | 21.51 ± 3.61 | 23.28 |
| | (CD) | 65.61 ± 13.73 | 48.00 |
| Bending Length (centimeters) | (MD) | 8.5 | 9.2 |
| | (CD) | 9.2 | 4.4 |
| Drape Stiffness (centimeters) | (MD) | 4.3 | 4.6 |
| | (CD) | 2.6 | 2.2 |

The stretchable metallized nonwoven web was also tested to measure the amount of material (e.g., metal flakes and particles as well as fibrous materials) shed during normal handling. Materials were evaluated using a Climet Lint test conducted in accordance with INDA Standard Test 160.0-83 with the following modifications: (1) the sample size was 6 inch by 6 inch instead of 7 inch by 8 inch; and (2) the test was run for 36 seconds instead of 6 minutes. Results are reported for other types of commercially available fibrous webs for purposes of comparison. As shown in Table 2, there was some detectable flaking or detachment of the metallic coating and/or fibrous material from the stretchable metallized nonwoven web of the present invention. Despite the detectable flaking, the results are believed to show that most of the metallic coating adheres to the stretchable nonwoven web. Additionally, the relatively low level of particles detected by the test indicates the stretchable metallized nonwoven web may have properties that could be useful for applications such as, for example, clean-rooms, surgical procedures, laboratories and the like.

TABLE 2

CLIMET LINT TEST

| Material | 0.5μ Particles | 10μ Particles |
|---|---|---|
| Control Stretchable Spunbonded Polypropylene Web | 7993 | 246 |
| Stretchable Metallized Spunbonded Polypropylene Web | 12,998 | 1,543 |
| (Chicopee Mfg. Co.)[1] Workwell ® 8487 | 2,063 | 154 |
| (Chicopee Mfg. Co.)[1] Solvent Wipe ® 8700 | 1,187 | 2 |
| (Fort Howard Paper Co.)[2] Wipe Away ® | 119,628 | 3,263 |
| (IFC)[3] Like Rags ® 1100 | 7,449 | 127 |
| (James River Paper Co.)[4] Clothmaster ® 824 | 2,183 | 139 |
| (James River Paper Co.)[4] Maratuff ® 860W | 36,169 | 377 |
| (K-C)[5] Kimtex ® | 2,564 | 100 |

TABLE 2-continued

| CLIMET LINT TEST | | |
|---|---|---|
| Material | 0.5μ Particles | 10μ Particles |
| (K-C)[5] Crew ® 33330 | 1,993 | 42 |
| (K-C)[5] Kimwipes ® 34133 | 37,603 | 2,055 |
| (K-C)[5] Kimwipes ® EXL | 31,168 | 2,240 |
| (K-C)[5] Kaydry ® 34721 | 10,121 | 1,635 |
| (K-C)[5] Teri ® 34785 | 21,160 | 3,679 |
| (K-C)[5] Teri ® Plus 34800 | 14,178 | 730 |
| (K-C)[5] Kimtowels ® 47000 | 106,014 | 46,403 |
| (Scott Paper Co.)[6] Wypall ® 5700 | 22,858 | 1,819 |

[1]Chicopee Manufacturing Co. (Subs. of Johnson & Johnson), Milltown, New Jersey
[2]Fort Howard Paper Co., Green Bay, Wisconsin
[3]IFC Nonwovens Inc., Jackson, Tennessee
[4]James River Paper Co., Richmond, Virginia
[5]Kimberly-Clark Corporation, Neenah, Wisconsin
[6]Scott Paper Co., Philadelphia, Pennsylvania While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A stretchable metallized nonwoven web comprising:

at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and a metallic coating substantially covering at least a portion of at least one side of the nonwoven web.

2. The stretchable metallized nonwoven web of claim 1 wherein the nonwoven web of non-elastomeric thermoplastic polymer fibers is a selected from a nonwoven web of non-elastomeric meltblown thermoplastic polymer fibers, a nonwoven web of non-elastomeric spunbonded thermoplastic polymer fiber/filaments and a nonwoven bonded carded web of non-elastomeric thermoplastic polymer fibers.

3. The stretchable metallized nonwoven web of claim 2 wherein the meltblown fibers include meltblown microfibers.

4. The stretchable metallized nonwoven web of claim 3 wherein at least about 50 percent, as determined by optical image analysis, of the meltblown microfibers have an average diameter of less than 5 microns.

5. The stretchable metallized nonwoven web of claim 2 wherein the non-elastomeric meltblown thermoplastic polymer fibers comprise a polymer selected from the group consisting of polyolefins, polyesters, and polyamides.

6. The stretchable metallized nonwoven web of claim 5 wherein the polyolefin is selected from the group consisting of one or more of polyethylene, polypropylene, polybutene, ethylene copolymers, propylene copolymers, and butene copolymers.

7. The stretchable metallized nonwoven web of claim 2 wherein the nonwoven web further comprises one or more other materials selected from the group consisting of wood pulp, textile fibers, and particulates.

8. The stretchable metallized nonwoven web of claim 7, wherein the textile fibers are selected from the group consisting of polyester fibers, polyamide fibers, glass fibers, polyolefin fibers, cellulosic derived fibers, multicomponent fibers, natural fibers, absorbent fibers, electrically conductive fibers or blends of two or more of said nonelastic fibers.

9. The stretchable metallized nonwoven web of claim 7, wherein said particulate materials are selected from the group consisting of activated charcoal, clays, starches, metal oxides, and super-absorbent materials.

10. The stretchable metallized nonwoven web of claim 1 wherein the nonwoven web has a basis weight of from about 6 to about 400 grams per square meter.

11. The stretchable metallized nonwoven web of claim 1 wherein the thickness of the metallic coating ranges from about 1 nanometer to about 5 microns.

12. The stretchable metallized nonwoven web of claim 11 wherein the thickness of the metallic coating ranges from about 5 nanometers to about 1 micron.

13. The stretchable metallized nonwoven web of claim 1 wherein the metallic coating is selected from the group consisting of aluminum, copper, tin, zinc, lead, nickel, iron, gold, silver, copper based alloys, aluminum based alloys, titanium based alloys, and iron based alloys.

14. The stretchable metallized nonwoven web of claim 1 wherein the metallic coating comprises at least two layers of metallic coating.

15. The stretchable metallized nonwoven web of claim 1 wherein the stretchable metallized nonwoven web is adapted to be electrically conductive.

16. The stretchable metallized nonwoven web of claim 15 wherein the nonwoven web is adapted to remain electrically conductive when stretched at least about 25 percent.

17. The stretchable metallized nonwoven web of claim 16 wherein the nonwoven web is adapted to remain electrically conductive when stretched from about 30 percent to about 100 percent.

18. A multilayer material comprising:

at least one layer of a stretchable metallized nonwoven web, the stretchable metallized nonwoven web comprising at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and a metallic coating substantially covering at least a portion of at least one side of the nonwoven web; and at least one other layer.

19. The multilayer material of claim 18 wherein the other layer is selected from the group consisting of woven fabrics, knit fabrics, bonded carded webs, continuous spunbond filament webs, meltblown fiber webs, and combinations thereof.

20. A process of making a stretchable metallized nonwoven web comprising:

providing at least one nonwoven web of non-elastomeric thermoplastic polymer fibers, the nonwoven web having been heated and then necked so that it is adapted to stretch in a direction parallel to neck-down at least about 10 percent more than an identical untreated nonwoven web of fibers; and metallizing at least one portion of at least one side of the nonwoven web so that said portion is substantially covered with a metallic coating.

* * * * *

UNITED STATES PATENT AND TRADEMARK OFFICE

CERTIFICATE OF CORRECTION

PATENT NO. : 5,316,837

DATED : May 31, 1994

INVENTOR(S) : Bernard Cohen

It is certified that error appears in the above-identified patent and that said Letters Patent is hereby corrected as shown below:

Column 2, line 17, "[maximum stretch..." should read --[(maximum stretch...--;

Column 3, line 42, "and is of ten ref erred" should read --and is often referred--.

Signed and Sealed this

Ninth Day of January, 1996

Bruce Lehman

*Attest:*

BRUCE LEHMAN

*Attesting Officer*

*Commissioner of Patents and Trademarks*